US007118117B2

(12) United States Patent
Terry

(10) Patent No.: US 7,118,117 B2
(45) Date of Patent: Oct. 10, 2006

(54) SKATEBOARD TENSION STRAP

(76) Inventor: Vincent P. Terry, 1939 24th Ave., Oakland, CA (US) 94610

( * ) Notice: Subject to any disclaimer, the term of this patent is extended or adjusted under 35 U.S.C. 154(b) by 165 days.

(21) Appl. No.: 10/729,586

(22) Filed: Dec. 4, 2003

(65) Prior Publication Data

US 2004/0113414 A1 Jun. 17, 2004

Related U.S. Application Data

(60) Provisional application No. 60/431,278, filed on Dec. 5, 2002.

(51) Int. Cl.
*A63C 11/00* (2006.01)

(52) U.S. Cl. ..... 280/87.042; 280/809

(58) Field of Classification Search ..... 280/87.01, 280/87.021, 87.041, 87.042, 809, 816
See application file for complete search history.

(56) References Cited

U.S. PATENT DOCUMENTS 4,289,325 A * 9/1981 Whitacre ..... 280/87.042
4,537,100 A * 8/1985 Palm ..... 81/177.85
5,026,088 A * 6/1991 Stuart ..... 280/637
5,092,506 A * 3/1992 Bolduc ..... 224/658
5,221,111 A * 6/1993 Younger ..... 280/809
6,089,592 A * 7/2000 Negus ..... 280/620
6,702,328 B1 * 3/2004 Malleis et al. ..... 280/809
6,935,645 B1 * 8/2005 Fuhrmeister ..... 280/87.042

* cited by examiner

*Primary Examiner*—Christopher P. Ellis
*Assistant Examiner*—Brian Swenson
(74) *Attorney, Agent, or Firm*—Bruce H. Johnsonbaugh

(57) ABSTRACT

A skateboard tension strap is provided for temporarily connecting a skateboard to the body of the user in order to allow the user to perform "hands-free" stunts without having to use his or her hands to hold or control the skateboard. A waist belt is worn by the user. A tension strap resiliently and adjustably connects the waist belt to the skateboard. The tension strap includes an elastic section and has a first end anchored to the skateboard and a second, upper end for adjustably connecting the tension strap to the waist belt. A connector extends between the waist belt and the upper end of the tension strap to provide the adjustable connection. The tension strap and the waist belt are sufficiently wide and flat to allow the application of logos or other designs thereto.

5 Claims, 4 Drawing Sheets

SKATEBOARD TENSION STRAP

CROSS-REFERENCE TO RELATED APPLICATION

This application claims the benefit of and priority from U.S. provisional application Ser. No. 60/431,278 filed on Dec. 5, 2002.

BACKGROUND AND SUMMARY OF INVENTION

The skateboard tension strap according to the present invention has its birth from the invention of the skateboard, itself, and will revolutionize the art of professional "extreme"-style skateboarding. Specifically, my invention relates to a particular set of devices, the skateboard strap design, itself, and the "tension" device, proportionate with the concept of professional freestyle skateboarding.

Aside from having to bend at the knees in doing "limited" (not more than two) 360 degree revolutions holding the skateboard, the "professional" extreme style skateboarder has not advanced to a "continuous" flow of gymnastic type, "high" degree of difficulty acrobatic stunts, during his "showmanship" of professional freestyle skateboarding. The professional industry of skateboarding has not seen even the best of seasoned riders do five or six 360 degree revolutions (as in professional iceskating) or "aerial," "death defying" stunts on his board with near perfect skill.

Moreover, the art of professional extreme skateboarding is a play of colorful showmanship. The particular design of my invention allows the professional to give more attention to the "mechanical" technique of difficult stunts, using virtually no energy to constantly "hold" the skateboard. My invention lets the professional do low-crouching (bending at the knees) or standing (fully erect) 360 degree revolutions with the aid of the specific "tension" portion of the skateboard strap. The showmanship of this invention comes into play when the rider can do other things with his hands, like salute the crowd, or hold both arms outstretched like a helicopter while in flight; and even still, with his hands akimbo (both hands on hips) in a gesture of pure perfection and confidence. All of this is enabled by the "tension" portion of my invention, allowing the professional raider freedom from holding the skateboard, thus alleviating any difficulty of constantly "maintaining" (holding) the skateboard, which can limit a continuous flow and succession of stunts.

PRIOR ART REFERENCES

The prior art includes U.S. Pat. No. 4,732,400 to Santini for a "Scooter Board;" U.S. Pat. No. 4,811,971 to Phillips for a "Ride-on Vehicle;" U.S. Pat. No. 4,179,134 to Atkinson for a "Removable Trainer Handle and Brake for Skateboard;" U.S. Pat. No. 4,289,325 to Whitacre for a "Skateboard" with an extra long front to attach a rope and handle; U.S. Pat. No. 4,887,825 to Allen et al for a "Skateboard" with a flexible cord passing through a hole in the center, and U.S. Pat. No. 5,221,111 to Younger. Other examples of prior art include U.S. Pat. Nos. 6,089,592 and 5,020,827.

Currently, all former Skateboard Accessories to Assist in Airborne Maneuvers have failed to entertain specifically the professional skateboard rider due to inefficient functionality of such an accessory. In one way or the other, in the aforementioned prior art references, the inventions lacked "specific" design, or a specific device to allow "unlimited" and "unhampered" use. For example, some particular part of such an invention either obstructed a smooth ride or could not be used without maintaining constant pressure by the rider's arm, and expending a great deal of arm, muscle-energy in maintaining a solid connection between the rider and board.

My invention seeks to not only free-up the professional skateboarder's hands, and save energy from holding any loose fitting, insufficient accessory where showmanship is important, but also seeks to make my product a "fashion statement" in today's advertisement and marketing industry. By making my invention "functional" to the professional, as well as fashionable to the "urban culture" of extreme skateboarding, it can revolutionize the industry drastically. My invention is a "specific" concept of working mechanics, to enhance professional articulation to the "art" of skateboarding, with the endless possibilities of showmanship and urban fashion style.

Specifically, the concept is drawn from the present skateboard invention and allows, namely, the competitive, professional skateboarder to do a "higher" degree of aerial, as well as "acrobatic" stunts with more precision and picturesque end results. The skateboard "tension" strap portion, and the skateboard "strap" design itself, will increase threefold the "optimal" criteria for the professionals' freestyle program in its entirety. The particular hardware (materials) to make the product are lightweight but dependable. The specifications of the skateboard "strap" design make it more than "accessory" to the professional, but also makes the invention an "urban culture" fashion market medium.

A primary object of the invention is a skateboard tension strap which resiliently connects the skateboard to a waist belt worn by the user, thereby allowing the user to perform "hands-free" stunts.

A further object is to provide a skateboard tension strap having a design that allows a variety of logos, names or fashion displays or figures to be applied thereto.

Other objects and advantages of the invention will become apparent from the following detailed description and drawings wherein:

DETAILED DESCRIPTION OF THE DRAWINGS

Figure 1:
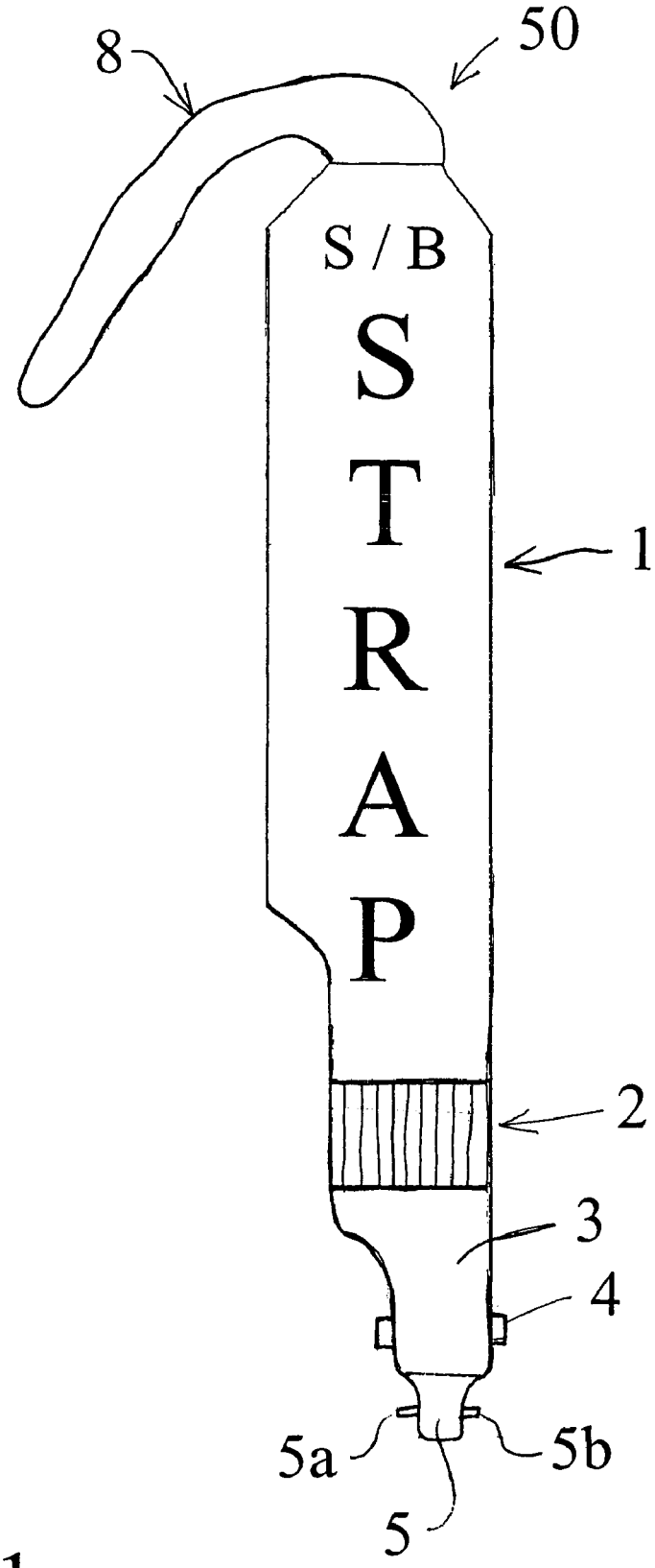
FIG. 1 is a front elevational view of a skateboard tension strap according to the present invention.
Figure 2:
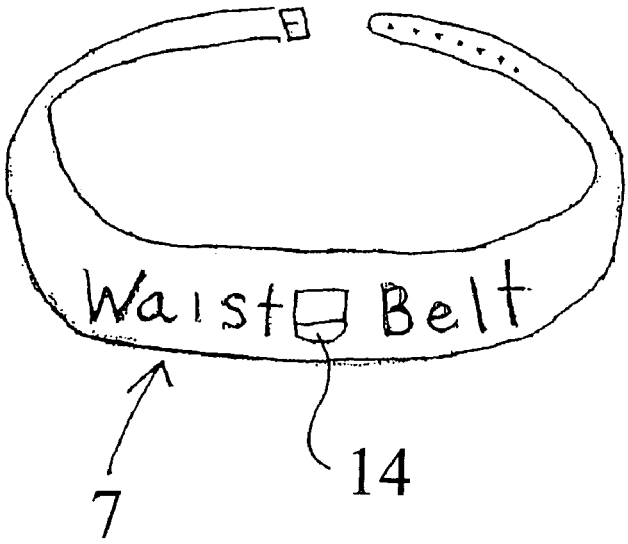
FIG. 2 is a perspective view of a waist belt worn by a user when the skateboard tension strap is in use.
Figure 3:
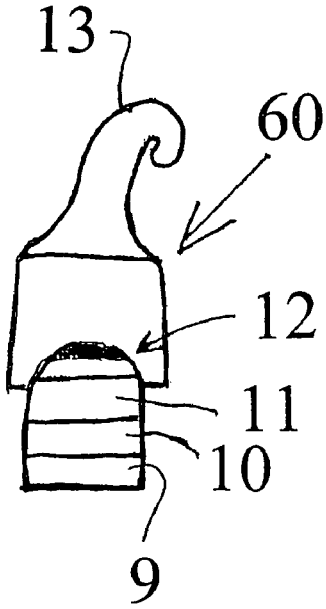
FIG. 3 is a schematic representation of a belt hook used to adjustably connect the skateboard tension strap of FIG. 1 to the waist belt of FIG. 2.
Figure 6:
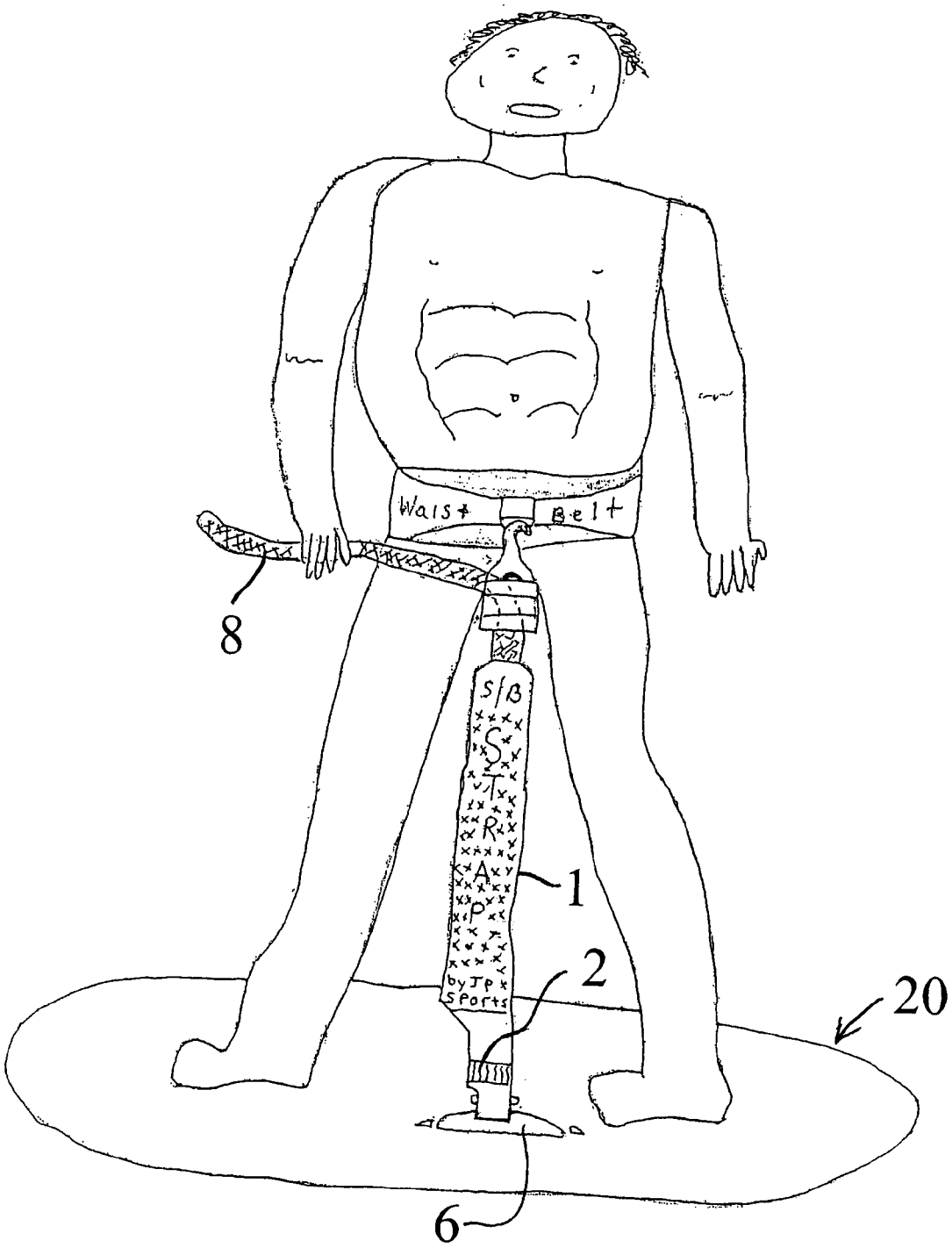
FIG. 6 is a perspective view showing a user temporarily and adjustably connected to a skateboard by the present invention.

FIG. 1 illustrates a skateboard tension strap shown generally as 50. The strap 50 includes a central portion 1 that is relatively wide and flat, thereby lending itself to the application of a commercial logo, name or a fanciful design or "fashion" statement. Strap 50 has a first end 5 adapted to be anchored to the skateboard (see FIG. 6) and a second end 8 for adjustably connecting the strap 1 to waist belt 7 (FIG. 2). My invention also includes connecting means shown generally as 60 in FIG. 3 for adjustably connecting the second or upper end 8 of tension strap means 50 to waist belt 7, thereby allowing the skateboard user to perform hands-free stunts without having to use his or her hands to hold or control the skateboard. The tension strap means 50 includes an elastic section 2 which allows the user to adjust the amount of tension in strap means 50. To increase the tension in strap means 50, the user simply pulls upwardly on the free end (or second end) 8 of strap 50. As described below, the second or upper end 8 is threaded through a multi-level buckle 60 including a plurality of slidable loops. The slidable loops are designed to allow the user to pull upwardly on end 8 to increase tension and, when the user releases the upper end 8, the slidable loops hold the strap means 50 in that particular position. In order to release the tension, the user must pull in the opposite direction to release the upper end 8 from the slidable loops of connecting means 60. It is to be understood that alternate connecting means may be utilized to adjustably connect the upper end (or second end) 8 of strap means 50 to waist belt 7. It is also to be understood that alternate anchors may be utilized for removably attaching the first end 5 of the tension strap means 50 to the skateboard.

The "tension" strap adjustment portion 8 of my invention (FIG. 1) will be designed of a durable nylon belt and can be connected to the strap 1 by either sewing or by rivets set in optimal positions. The "belt hook" portion 13 (FIG. 3) of the skateboard strap will connect to the waist belt hook connection 14, carried by the waist belt 7 (FIG. 2). The upper or second end 8 of nylon tension strap 50 will be threaded into the sliding loops of connecting means 60 by being fed behind loop 9, in and over loop 10, then under and up through loop 11 as a means to tighten and release tension.

The operation of the "tension release lip" 12 is vital to the complete workability of the skateboard tension strap concept. Besides being an important connection between the rider's waist belt and the board, the "tension release lip" (the shaded portion 12) works to release tension before disengaging the skateboard strap for non-use. The shaded portion is simply pushed out with the thumb, while simultaneously holding the tension strap portion so as to release the right amount of drag. The tension release lip 12 acts as a manual "adjustment" device, whereas the tension strap portion 8 is used by pulling the tension strap upward, the reason for the unique threading of loops 9, 10 and 11 to increase tension for use.

The skateboard strap 1 is directly connected to the elastic portion 2 by sewing or rivets whichever method is optimal. The elastic portion 2 and the tension strap portion 8, along with the male/female connection 5,6 fully engaged, will increase tension between the rider and the skateboard without constant manual operation by the rider. After the rider applies the right amount of tension to his skateboard strap, he is free to let the tension part of the strap go, without it dangling, where then he can concentrate on his particular stunts.

Figure 4:
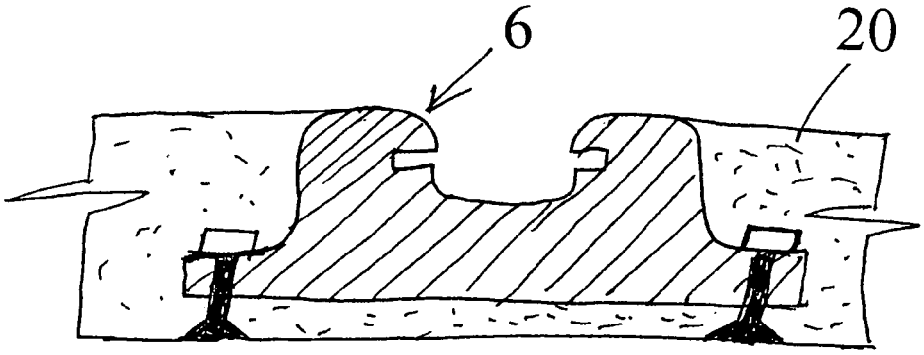
FIG. 4 is a sectional view of a female connector or anchor used to connect the skateboard tension strap to the top of a skateboard.
Figure 5:
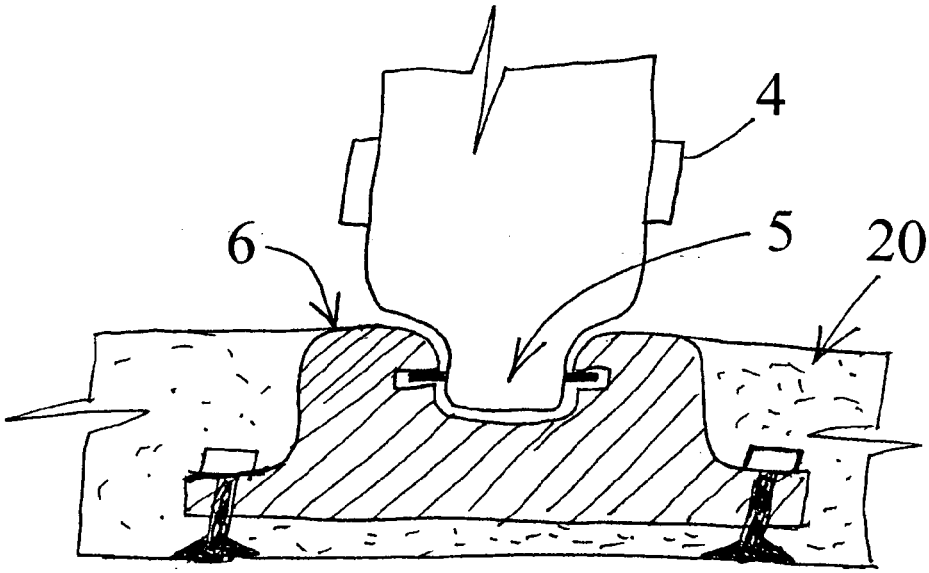
FIG. 5 is a sectional view of the anchor of FIG. 4 and the lower end of the tension strap connected thereto.

The male connector portion 3 of the skateboard strap is equipped with two release buttons 4 working in unison with each other to disengage the strap from the skateboard when not in use. The anchoring pins 5*a* and 5*b* should be of a design that does not require the release buttons 4 to be engaged for use. Rather, the locking and release pins should lock into place simply by directing the male connector 3 into the female connector 6 (FIG. 4). Moreover, the female connector 6 will be designed with an "oval" shaped topside so that the rider's feet will glide smoothly over the female connector 6, thereby not hampering the normal course of riding and stunts. The female connector device will be of optimal design when the locking and release pins make a solid connection, implying a thin design, and again, a smooth rounded top surface, so as not to protrude while riding.

In emphasizing the fashionable aspects of my product, it must be noted that if a product works and is marketable, then it has a great chance of selling. My invention also takes into consideration the climate of urban fashion, as a means of promoting a successful product. As has been seen by companies like NIKE and others, a properly designed and reliable product beats out its competitors. The specifications of the skateboarding strap and cummerbund design of the waist belt will be made to accompany a trademark name and logo of some type in bold print to again make the product fashionable in conjunction with workability. The lettering for the designer name and the artwork for personalized skateboarding straps will be original, colorful and creative. While standard skateboarding straps will be of a less expensive material, such as durable canvas, standard straps will still be made with modest fashion statements in mind. Again, for the professional skateboarder, the style of his skateboarding strap will only be a matter of creativity and imagination.

The assembly for the skateboarding tension strap for the flat plate fixture is as follows. The underside of the skateboard is hollowed out (filled) with a correct drill bit (not included in the product packaging) and a simple measuring device (included in the product). First, the center of the skateboard is found by using a balancing chip (listed as x and included in the product), placed in the approximate center of the board and adjusted until the perfect center is found. The balancing chip is at that point used as the outline where the assembly person takes a pencil to outline around the balancing chip piece. Done correctly, using the measuring device and proper household tools, and with photo diagrams in the instructions, there will be no need for professional service. This is a workable approach to easy assembly and the infinite details can be worked out during the production stage.

Nevertheless, after the hollowing out process is complete, filled out fractions of an inch, the flat plate 25 is then inserted to ensure a snug fit where there is no obstruction to normal riding. This implies that the filling out process must be done with a fair degree of care. The use of two flathead screws would be optimal and are to be inserted from the bottom of the flat plate assembly. The board is then turned over, topside up, and the female connector and its fastening nuts are secured into place. To re-emphasize the unique design of the female connector, the top of the female connector should be rounded, preferably of an "oval" design. Again, it should be of a design strong enough to support the applicable tension applied between the rider and his board, yet the smooth "rounded" surface of the female connector must not interfere with the normal course of riding. The design of the female connector will ensure that the fastening nuts are embedded into each screw slot as a means to prevent obstruction. The assembly of the skateboarding strap is then complete and ready for use.

Although the skateboarding tension strap can be used by the recreational skateboarder, the total concept around the unique design is especially made for the professional freestyle competitor. The special skateboarding "tension" strap design, the designed strap and its fashionable flare, the mechanics that make the product functional to the professional, are unmatched. After assembly, the skateboarding tension strap is easy to use, simply by engaging the male/female connection, and finally by increasing tension (by means of the strap) between the rider and his board. The rider does not need to constantly maintain attention to the skateboarding tension strap, even while engaged and not in use. Tripping over the skateboarding strap can be avoided simply by applying the right amount of loose tension for riding. However, when the professional gets to a point in his freestyle program where the technique and perfect performance of his "multiple" 360 degree, and unlimited "aerial acrobatic" stunts are tantamount, he only has to pull the upper portion 8 of the tension strap means 50 and concentrate on a flawless display of picturesque skateboarding skill. Moreover, the fashionable quality and projection of the product make it prime for the "urban" cultural society. I see this product, along with the end result it produces, as a complete success in the art of professional skateboarding.

The foregoing description of the invention has been presented for purposes of illustration and description and is not intended to be exhaustive or to limit the invention to the precise form disclosed. Modifications and variations are possible in light of the above teaching. These particular embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A skateboard tension strap for temporarily connecting a skateboard to the body of a user, allowing the user to perform "hands-free" stunts without having to use his or her hands to hold or control the skateboard, comprising:

a waist belt adapted to be worn by the user around his or her waist, tension strap means for resiliently and adjustably connecting said waist belt directly to said skateboard whereby tension may be maintained between the skateboard and the waist belt without requiring the user to hold said tension strap means with a hand, so that both of the user's hands are free for stunts, said tension strap means having a first end adapted to be anchored to said skateboard and a second end for adjustably connecting said tension strap means to said waist belt, and connecting means for adjustably connecting said second end of said tension strap means to said waist belt, thereby allowing said skateboard user to perform hands-free stunts without having to use his or her hands to hold or control said skateboard, said connecting means comprising a multi-level buckle through which said second end of said tension strap is threaded and whereby tension in said tension strap is increased and maintained by the user pulling upwardly on said second end of said tension strap.

2. The apparatus of claim 1 wherein said multi-level buckle means comprises a plurality of slidable loops, said second end of said tension strap means is elongated and adapted to be pulled by said user to increase the tension in said tension strap means.

3. The apparatus of claim 1 further comprising anchor means for removably attaching said first end of said tension strap means to said skateboard.

4. The apparatus of claim 1 wherein said tension strap means includes a sufficiently wide and flat central section on which logos or designs may be displayed.

5. The apparatus of claim 1 wherein said waist belt is sufficiently wide and flat to allow logos or designs to be applied thereon.

* * * * *